US009988244B2

(12) United States Patent
Makovec et al.

(10) Patent No.: US 9,988,244 B2
(45) Date of Patent: Jun. 5, 2018

(54) TRACK SYSTEM FOR AN ESCALATOR OR MOVING WALKWAY

(71) Applicant: Inventio AG, Hergiswil (CH)

(72) Inventors: Christoph Makovec, Wiener Neustadt (AT); Michael Matheisl, Vösendorf (AT); Robert Schulz, Vienna (AT); Thomas Illedits, Neufeld (AT); Thomas Novacek, Schwechat (AT); Uwe Hauer, Nienburg (DE); Jürg Burri, Hirschthal (CH)

(73) Assignee: INVENTIO AG, Hergiswil (CH)

( * ) Notice: Subject to any disclaimer, the term of this patent is extended or adjusted under 35 U.S.C. 154(b) by 0 days. days.

(21) Appl. No.: 14/432,085

(22) PCT Filed: Sep. 18, 2013

(86) PCT No.: PCT/EP2013/069367
§ 371 (c)(1),
(2) Date: Mar. 27, 2015

(87) PCT Pub. No.: WO2014/048809
PCT Pub. Date: Apr. 3, 2014

(65) Prior Publication Data

US 2015/0239711 A1 Aug. 27, 2015

(30) Foreign Application Priority Data

Sep. 27, 2012 (EP) ..... 12186427

(51) Int. Cl.
*B66B 21/00* (2006.01)
*B66B 23/14* (2006.01)
(Continued)

(52) U.S. Cl.
CPC ..... *B66B 23/14* (2013.01); *B66B 21/02* (2013.01); *B66B 21/10* (2013.01); *B66B 23/00* (2013.01);
(Continued)

(58) Field of Classification Search
CPC ..... B66B 23/00; B66B 23/14
(Continued)

(56) References Cited

U.S. PATENT DOCUMENTS 6,296,111 B1 * 10/2001 Mekanik ..... B65G 21/06 198/836.3
6,644,210 B1 11/2003 Pfleger et al.
2007/0029161 A1 * 2/2007 Streibig ..... B66B 23/14 198/326

FOREIGN PATENT DOCUMENTS

CN 1907834 A 2/2007
EP 2 050 708 A2 7/2008
(Continued)

OTHER PUBLICATIONS

English_Abstract_of_JP2009184771A.

*Primary Examiner* — Gene O Crawford
*Assistant Examiner* — Lester Rushin, III
(74) *Attorney, Agent, or Firm* — Ladas & Parry LLP

(57) ABSTRACT

A track module of an escalator or a moving walkway comprises at least two support structures and at least one guide rail. Each support structure includes at least two supports and at least one cross strut, wherein the cross strut is arranged between the at least two supports and connects these together. Each support has a foot fastening region which, in the installed state, is fastened to a carrying structure. Moreover, a balustrade fastening region, to which in the installed state at least a part of a balustrade is fastened, is formed at each support, so that static and dynamic loads
(Continued)

acting on the balustrade are transmissible directly to the carrying structure by way of the supports.

15 Claims, 3 Drawing Sheets

(51) Int. Cl.

| | |
|---|---|
| ***B66B 23/00*** | (2006.01) |
| ***B66B 21/02*** | (2006.01) |
| ***B66B 21/10*** | (2006.01) |
| ***B66B 23/24*** | (2006.01) |
| *B66B 19/00* | (2006.01) |

(52) U.S. Cl.
CPC ..... *B66B 23/24* (2013.01); *B66B 19/007* (2013.01); *Y10T 29/49716* (2015.01); *Y10T 29/49826* (2015.01)

(58) Field of Classification Search
USPC ..... 198/326, 327, 335, 860.1
See application file for complete search history.

(56) References Cited

FOREIGN PATENT DOCUMENTS

| | | | |
|---|---|---|---|
| EP | 2 050 708 | A2 | 4/2009 |
| JP | 49 012579 | A | 2/1974 |
| JP | 58 151177 | U | 10/1983 |
| JP | 2009 184771 | A | 8/2009 |
| SU | 672135 | A1 | 7/1979 |
| TW | 543650 | | 7/2003 |
| TW | 1369333 | | 8/2012 |
| TW | 1370099 | | 8/2012 |
| WO | WO 2014/48809 | A1 | 4/2014 |

* cited by examiner

TRACK SYSTEM FOR AN ESCALATOR OR MOVING WALKWAY

RELATED APPLICATION INFORMATION

This application is a 371 of International Application PCT/EP2013/069367 filed 18 Sep. 2013 which claims priority from EP Patent Application Number 12186427.6 filed 27 Sep. 2012, the content of which is incorporated herein by reference.

The invention relates to a track module, an escalator with a step belt or a moving walkway with a plate belt, an assembly method, and a modernisation method for escalators and moving walkways. The escalator or moving walkway has in the length direction thereof balustrades arranged laterally of the step belt or plate belt as well as a first deflecting region and a second deflecting region. The plate belt or the step belt is arranged between the first deflecting region and the second deflecting region to circulate. In addition, the escalator or moving walkway includes at least one guide rail, which is arranged between the deflecting regions, for guidance of the step belt or plate belt.

Escalators and moving walkways of the aforesaid kind have a support frame, for example a framework, at and in which the stationary components such as guide rails, bearing blocks and the balustrades, as well as the moving components such as the step belt or plate belt, the deflecting axle and parts of the drive, are arranged.

By way of example, disclosed in EP 2 050 708 A2 is a moving walkway having a support frame including two longitudinal profile members extending in length direction of the moving walkway. The longitudinal profile members are connected together by means of cross struts and form a self-supporting, stable frame. Guide tracks for guidance of the step belt are formed in the longitudinal profile members. In addition, fastening regions for feet and for balustrade supports are provided at the longitudinal profile members. This frame can also be subdivided into several sections or frame modules which can be joined together at the ends.

The construction disclosed in EP 2 050 708 A2 has the disadvantages that these longitudinal profile members have to be constructed to be very stiff in bending and torsion, since transverse forces acting on the balustrade and oriented orthogonally to the running direction of the moving walkway have to be supported by the vertical sections of the longitudinal profile member cross-section. Such transverse forces are caused by, for example, users who are leaning, by blows to the balustrade and the like, and due to the usual constructional height of the balustrade act as high bending moments or bending forces on the longitudinal profile members. The necessary stiffness in bending and torsion has the consequence that these longitudinal profile members have a high weight per meter, a large profile member cross-section and a large profile member wall thickness and as a result handling is made very difficult. Moreover, such profile members are very expensive in production and processing and require expensive production means such as press tools, press dies, assembly templates and chucking tools.

The object of the present invention is therefore to create an escalator or a moving walkway, which has between the deflecting regions a structure with guide rails, which can be easily produced and is economic.

This object is fulfilled by a track module of an escalator or a moving walkway which comprises at least two support structures and at least one guide rail. Each support structure includes at least two supports and at least one cross strut.

The cross strut is arranged between the at least two supports and connects these together. Each support has, at the lower end thereof referred to its position of installation, a foot fastening region which in the installed state is fastened to a carrying structure. Each support further includes, at the upper end referred to its position of installation, a balustrade fastening region to which in the installed state at least a part of a balustrade is fastened. Since the support is provided with a balustrade fastening region and a foot fastening region the static and dynamic loads acting on the balustrade can be transmitted directly to the carrying structure by way of the supports. In addition, at least one rail fastening region for fastening of the at least one guide rail is formed at each support structure, wherein the at least one guide rail is arranged orthogonally to the cross struts of the support structures and is fastened to the rail fastening regions of the support structures.

The track module can, during assembly, be fastened to the carrying structure separately from the deflecting regions. As a result, installation of the escalator or the moving walkway is substantially simplified. In installed state, one or more track modules is or are arranged between deflecting regions of the escalator or moving walkway. The deflecting regions are, moreover, connected together by the track modules. Since the guide rail, like the balustrade, is fastened to the support structure the position thereof relative to one another is very precise already from the factory, whereby the adjustment effort for assembly of the escalator or the moving walkway at the place of installation is minimised.

As already mentioned, the support supports static and dynamic loads such as, for example, transverse forces and bending moments, which act on the balustrade, by way of the foot fastening region directly on the carrying structure, which, for example, can be a steel girder, a concrete foundation, a sufficiently stable floor and the like. The guide rails are fastened only to the rail fastening regions of the support structures and are thereby excluded from these transverse forces and bending moments. Correspondingly, the guide rails can be primarily designed for the loads attributable to the step belt or plate belt, which gives a simpler construction and light track modules.

The invention exploits, through conducting static and dynamic loads away via the supports, the inherent stability of the surroundings which are created by, for example, a foundation at the place of installation, a stairway of a building or by additional measures at the building such as, for example, the installation of girders, ramps and the like. Dispensing with an intrinsically stable support frame or framework signifies a clear departure from current teaching that an escalator or a moving walkway has to have an inherently stable load-bearing structure. Through dispensing with a self-supporting, inherently stable support frame a moving walkway or an escalator with the afore-described track modules has a number of advantages.

Transverse forces of the balustrade are supported directly by the carrying structure erected at the building and not by the guide rails. As a result, the guide tracks thereof are not elastically deformed by the transverse forces and straight running of the plate belt or step belt is not impaired by transverse forces.

The support frame or framework, which is known from the prior art, of an escalator or a moving walkway often has, due to the required inherent stability, large dimensions and thereby substantially determines the appearance of the building or the interior space. By virtue of the afore-described concept an architect can have complete design freedom for the carrying structure. This certainly has to satisfy, over the span width of the moving walkway or the escalator, the prescribed loading requirements which the manufacturer prescribes, referred to the length of the moving walkway or the escalator, for the individual foot fastening regions, but he can otherwise freely select the appearance of the carrying structure and the arrangement thereof in the building. It is even possible, with curved guide rails having a curvature directed in vertical direction in the installed state, to produce a curved escalator or a curved moving walkway without problems. Even guidance of the step belt or plate belt in wave form in the running direction is possible. Thanks to the division in two track modules these can in addition be brought in the simplest way into an existing building and mounted at the intended place of installation.

Thrust forces acting on the escalator or the moving walkway in direction of the length can be transmitted by a suitable design of the support and the foot fastening region thereof to the carrying structure and supported or dissipated. The guide rails additionally serve in the length direction as struts between the support structures so that the thrust forces are distributed to several supports or foot regions. The thrust forces arising in the length direction of the escalator or the moving walkway barely load the guide rails and therefore do not have any effect on the dimensioning of the guide rails. The dimensioning of the guide rails is based only on the maximum occurring conveying load or passenger load required to be supported.

A particularly simple and economic design of the guide rail can be achieved if this is formed to be C-shaped in cross-section with respect to its length direction and has two guide tracks for the guide rollers or chain rollers of a step belt or plate belt. For preference, each of the two guide tracks is arranged on a respective one of the two parallel limbs of the C-shaped profile of the guide rail so that the two guide tracks are arranged in planes disposed one above the other when the guide rail is installed in the operationally ready escalator.

In addition, this guide rail can have at least one passage for the passing-through of the cross strut of a support structure. This makes possible a particularly compact construction of the escalator or the moving walkway, since the cross strut is then arranged between the forward run and the return run of the step belt or plate belt.

The rail fastening region for fastening of a guide rail can be formed at the support. This is preferably matched to the fastening means and the guide rail and has, for example, a defined hole pattern or defined mounts/or recesses. In order to facilitate mounting of the guide rail or guide track or guide rail, lugs serving for suspension of the guide rail can also be formed at the support in the rail fastening region. The suspended guide rails can then be fixed connected with the support by means of fastening elements such as screws, clamping claws, clamping wedges, clamping pins, spring clips and the like. Non-releasable connecting techniques can obviously also be used such as, for example, riveting, welding, gluing, clinching and the like.

The rail fastening region can obviously also be constructed for fastening a guide rail to the cross strut, wherein the afore-mentioned connecting techniques and joining techniques are equally usable for fastening of the guide rail to the cross strut.

In addition, at least one base fastening region for fastening of a base plate can be formed at the support. The base plate is preferably adjustable relative to the support so that compensation for production tolerances can be provided and a gap, which corresponds with legal requirements, between the step belt and the base plate can be set.

The support can also have at least one handrail-guide fastening region for the fastening of a handrail guide. This handrail guide can be a guide rail, one or more guide rollers, handrail mounts and the like.

The foot fastening region preferably includes a height adjusting device or height setting device which makes it possible to adjust the support in vertical direction. Compensation for non-planarities of the carrying structure over the length of the escalator or the moving walkway can thereby be provided in simple manner without needing to use additional material such as spacer plates, spacer sleeves, washers, wedges and the like.

An escalator usually comprises a step belt, balustrades arranged laterally of the step belt in the length direction of the escalator, as well as a first deflecting region and a second deflecting region, wherein the step belt is arranged between the first deflecting region and the second deflecting region to circulate. According to the invention the escalator comprises at least one track module, as described in more detail further above, arranged between the deflecting regions. The deflecting regions are connected together by a track module or several track modules joined together and the at least one guide rail of the at least one track module serves for guidance of the step belt between the two deflecting regions.

Analogously, a moving walkway comprises a plate belt, balustrades arranged laterally of the plate belt in the length direction of the moving walkway, as well as a first deflecting region and a second deflecting region, wherein the plate belt is arranged between the first deflecting region and second deflecting region to circulate. The moving walkway additionally comprises at least one track module, as described in more detail further above, arranged between the deflecting regions. The deflecting regions are connected together by a track module or by several track modules joined together and the at least one guide rail of the at least one track module serves for guidance of the plate belt between the two deflecting regions.

Regardless of whether it is an escalator or a moving walkway, the first deflecting region, the second deflecting region and at least one foot region of at least one track module arranged between the two deflecting regions can be fastened to the associated mounts. These mounts are arranged in distribution over the length of a carrying structure erected at the building. They can be set up during assembly of the escalator or the moving walkway, for example, by the mounting of bonding anchors in a concrete foundation serving as a carrying structure. The mounts can obviously already be arranged at the carrying structure, at the time of creating the carrying structure on the basis of a mounting plan or by means of provided templates.

In summary, it can be established that the afore-described escalator with a step belt or the moving walkway with a plate belt has a special construction, since an inherently stable support frame is dispensed with. A characteristic feature of the new construction is, in particular, that the first deflecting region, the second deflecting region and at least one foot region of at least one track module arranged between the two deflecting regions are fastened to the associated mounts of the carrying structure.

The assembly of an escalator or a moving walkway of the aforesaid kind also differs significantly from the known assembly concepts. This new assembly method comprises the steps in which the first deflecting region and the second deflecting region are fastened to a carrying structure, the at least one track module is fastened by its foot fastening regions to the carrying structure between the two deflecting regions, the two deflecting regions are connected together by the at least one guide rail of the at least one track module or by several guide rails of several track modules joined together, the step belt or plate belt is introduced between the deflecting regions to be movable in circulation and is guided by the at least one guide rail and the balustrades are fastened to the supports of the at least one support structure.

Although at least one track module is mentioned in the aforesaid assembly method this does not exclude the track module from also being able to be delivered, broken down into several individual parts such as support structures and guide rail sections, to the building site. A track module can be created from these individual parts for the first time by introducing the same between the deflecting regions of the escalator or the moving walkway. However, the track module can also be assembled from the individual parts prior to installation between the deflecting regions. The aforesaid assembly method can therefore be supplemented by the further step in which prior to fastening to the carrying structure at least one track module is formed by joining together at least two support structures and at least one guide rail and this track module is connected with the carrying structure instead of the individual parts such as travel tracks or guide tracks, supports or uprights and cross struts or cross girders.

The escalator or the moving walkway of the aforesaid kind is also particularly suitable for modernisation of an existing escalator or an existing moving walkway. Such a modernisation method comprises the steps in which an existing escalator or an existing walkway is removed as far as the framework, the emptied framework, serving as carrying structure, is provided in the region of its bottom chord with mounts to which the foot fastening regions of supports of a track module of the aforesaid kind can be fastened and a first deflecting region, second deflecting region and at least one track module of an escalator according to the invention or a moving walkway according to the invention is fastened in the emptied framework provided with mounts, wherein the foot fastening regions of the supports are connected with the mounts.

The escalator or the moving walkway with a light and economic structure, which is arranged between the deflecting regions, with guide rails is explained in more detail in the following on the basis of examples and with reference to the drawings, in which.

Figure 2:
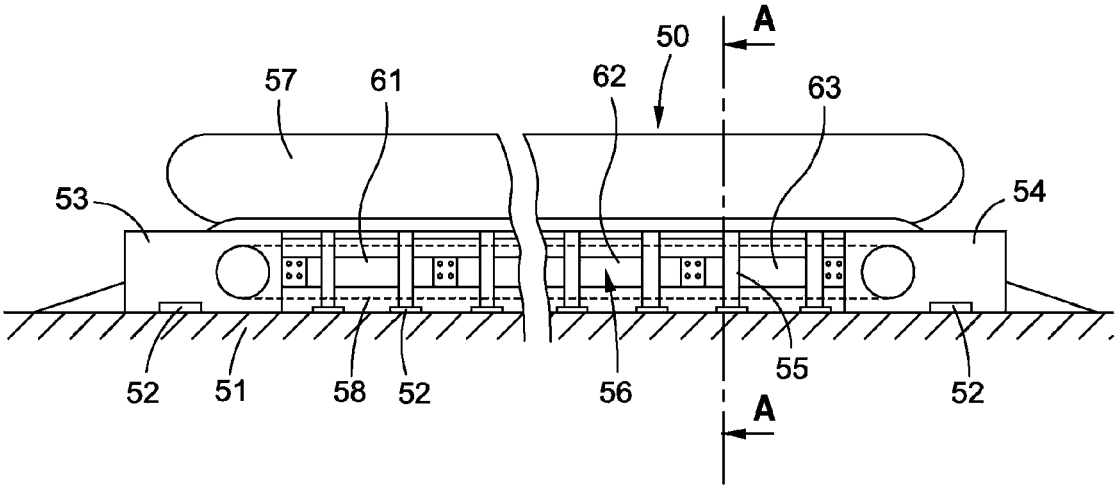
FIG. 2 shows, in side view and in schematic illustration, a moving walkway which is arranged on a carrying structure and which comprises support structures, guide rails, balustrades and an encircling plate belt, these being arranged between a first deflecting region and a second deflecting region.
Figure 3:
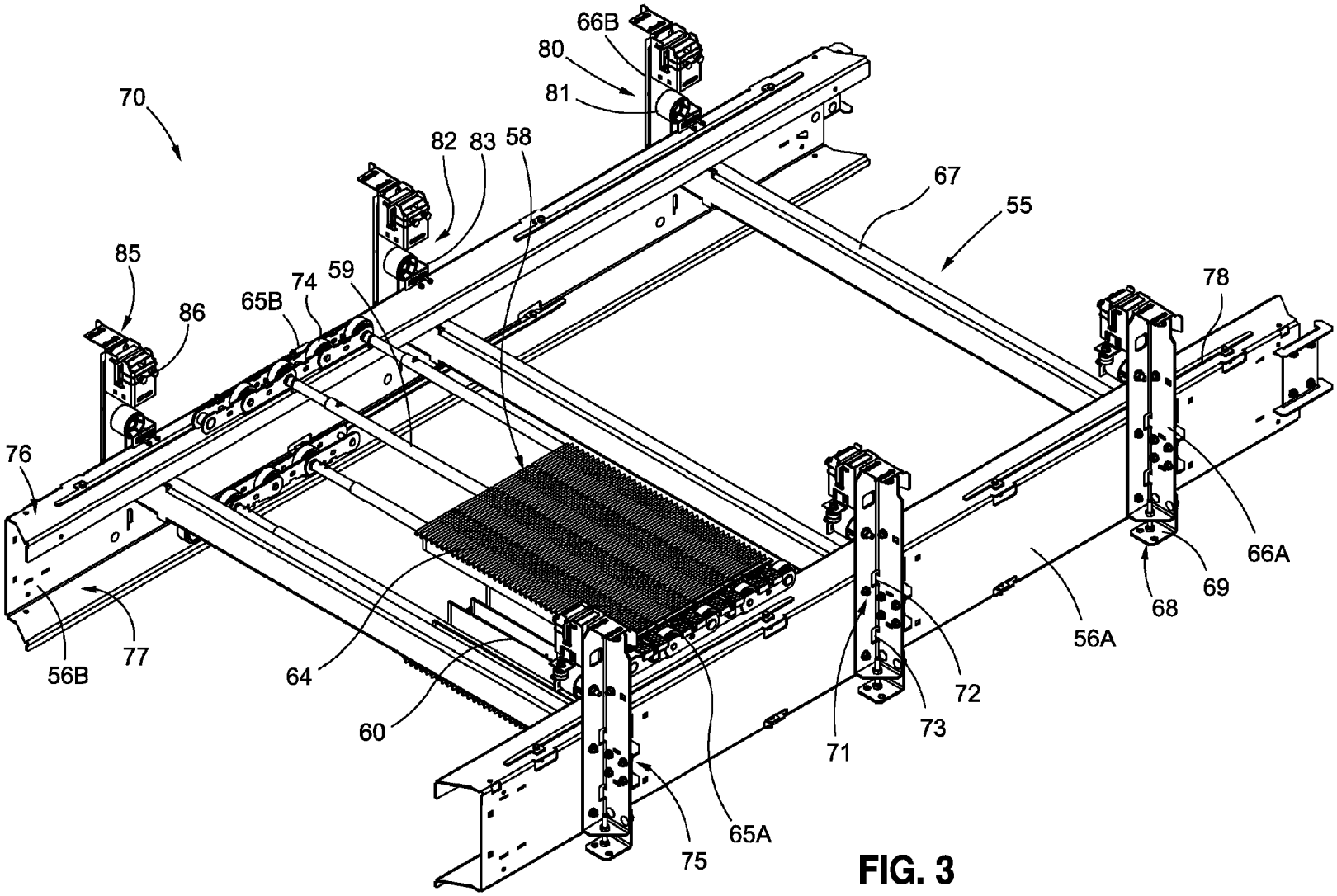
Figure 4:
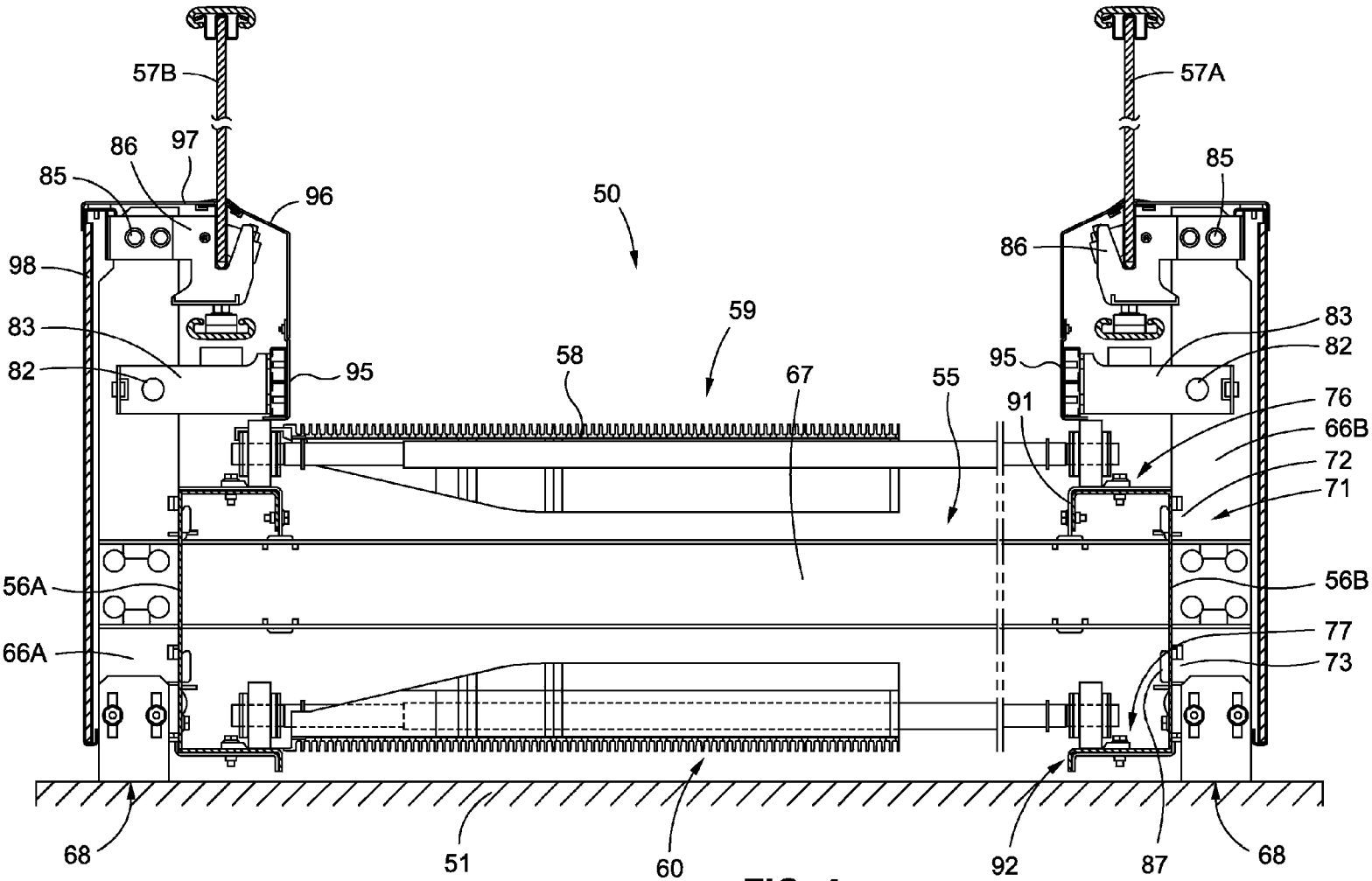

FIG. 3 shows, in three-dimensional view, a track module of the moving walkway of FIG. 2, formed from three support structures and two guide rails, wherein depicted on the guide rails are in each instance a plate belt section of the plate belt forward run and the plate belt return run so as to illustrate the function of the guide rail; and FIG. 4 shows the moving walkway of FIG. 2 in the cross-section A-A.

Figure 1:
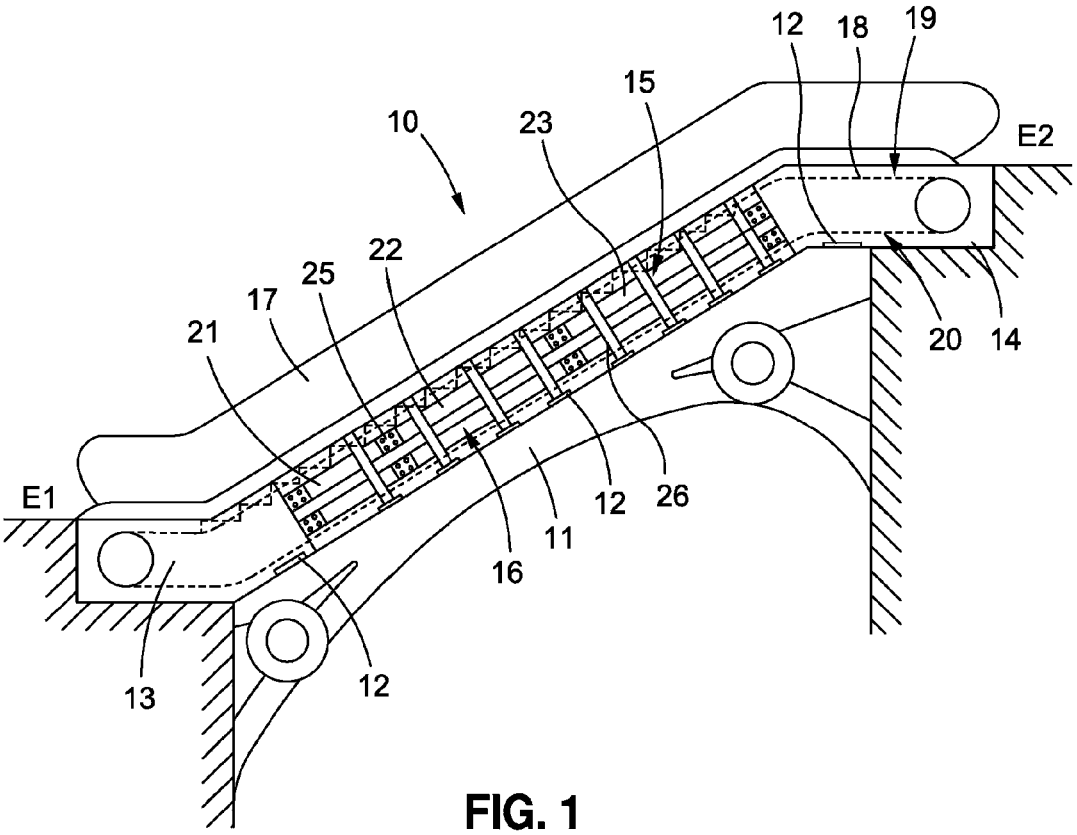
FIG. 1 shows, in side view and in schematic illustration, an escalator which is arranged on a carrying structure and which comprises support structures, guide rails, balustrades and an encircling step belt, these being arranged between a first deflecting region and a second deflecting region.

FIG. 1 shows, in schematic illustration and in side view, an escalator 10 which is arranged on a carrying structure 11 and which connects a lower plane E1 with an upper plane E2. The carrying structure 11 is designed, by way of example, in the style of a classical bridge so as to clearly show that this carrying structure 11 can be left to the design freedom of the architect. The carrying structure 11 can obviously also be a concreted staircase, a concrete ramp, a framework or two I-beams. The carrying structure 11 has to fulfil specific conditions with respect to its stiffness and load-bearing capability, which the manufacturer of the escalator or the escalator prescribes for the architect.

Mounts 12, on which the parts of the escalator 10 are mounted, are to be provided or subsequently mounted on this carrying structure 11 to be erected at the building. For the sake of better clarity only three mounts 12 are provided with reference numerals, although in the present example a mount 12 is present for each support structure. The mounts 12 can be simple mounting plates which, for example, are directly connected with the reinforcement of the carrying structure. Other suitable mounts 12 such as concrete anchors, screw holes, threaded rods, weld plates and the like are obviously also usable.

The escalator 10 comprises a first deflecting region 13 and a second deflecting region 14 as well as balustrades 17 arranged between the deflecting regions 13, 14, a circulating step belt and track modules 15, which have guide rails 16. For the sake of clarity only one track module 15 is provided with a reference numeral. The step belt 18 is deflected in the upper plane E2 and in the lower plane E1 and thus has a step belt forward run 19 and a step belt return run 20. For the sake of better clarity detailed illustration of the step belt 18 was dispensed with.

It is clearly apparent from FIG. 1 that the guide rails 16 are subdivided into guide rail sections 21, 22, 23 and are screw-connected or connected together by means of connecting plates 25. The guide rail sections 21, 22, 23 preferably have the same length, but, as evident in FIG. 1, can also have different lengths. Each of the guide rail sections 21, 22, 23 connects several support structures together to form a respective track module 15, whereby the guide rail is supported at the carrying structure 11. Of the support structures merely the supports 26 are oriented towards the viewing plane are visible, for which reason the support structures are explained in more detail only further below in the description of FIG. 3. Support structures of the moving walkway illustrated in FIG. 2 are indeed described there, but the construction and function of the support structures of the escalator 10 and the track modules 15 thereof correspond with the support structures 55 of the moving walkway 50 and the track modules 70 thereof described and shown in FIG. 3. Each of the supports 26 has a foot fastening region, which, as illustrated, is rigidly connected with the associated mount 12 of the carrying structure 11.

FIG. 2 shows, in side view and in schematic illustration, a moving walkway 50 which is arranged on a supporting structure 51. Serving as carrying structure 51 is a floor which has a sufficient strength. The moving walkway 50 can obviously also be mounted on one of the carrying structures such as explained in the description with respect to FIG. 1. The floor also has mounts 52 to which the components of the moving walkway 50 are fastened. Belonging to these components are a first deflecting region 53 and a second deflecting region 54 as well as support structures 55, guide rails 56, balustrades 57 and a circulating plate belt 58, which are arranged between the deflecting regions 53, 54. The construction of the moving walkway 50 thus substantially corresponds with the construction of the escalator 10 described in FIG. 1, even if in the present embodiments of FIGS. 1 and 2 two guide rails 26 arranged one above the other are illustrated for the escalator 10 and only one guide rail 56 for the moving walkway 50.

The guide rails 56 which are illustrated in FIG. 2, of the moving walkway 50 are also subdivided into guide rail sections 61, 62, 63 and are supported by the support structures 55, the foot fastening regions of which are fastened to the mounts 52. If the individual guide rail sections 61, 62, 63 and the support structures 55 associated therewith are already joined together in the factory to form track modules the transport by the manufacturer to the place of installation and assembly of the moving walkway 50 or the escalator 10 on the carrying structure 11, 51 provided at the place of installation can be significantly simplified.

FIG. 3 shows in three-dimensional view a track module 70 of the moving walkway 50 of FIG. 2, formed from three support structures 55 and two guide rails 56A, 56B or guide rail sections. Longer track modules with more than three support structures can obviously also be formed. Only a small part of the plate belt 58, namely a plate belt section 59 of the plate belt forward run and a plate belt section 60 of the plate belt return run, is illustrated on the guide rails 56A, 56B so as to show the function of the guide rails 56A, 56B. The individual plates 64 of the plate belt 58 are, in addition, illustrated only by half so as to show the two plate chains or roller chains 65A, 65B and the guide rollers 74 thereof on both sides of the plate belt 58. The support structures 55 each comprise two supports 66A, 66B, which are rigidly connected together by a cross strut 67.

The terms "bottom" and "top" define the position of the fastening regions at the support 66A, 66B in the installed state and refer to the direction of gravitational force. Each support 66A, 66B has a functionally identical construction. A foot fastening region 68 is formed at the support 66A, 66B at the bottom end. This comprises a height adjusting device 69 so as to provide compensation for non-planarities or differences in level of the carrying structure (not illustrated). Above the foot fastening region 68 the support 66A, 66B has a rail fastening region 71. This rail fastening region 71 is subdivided into a top rail fastening point 72 and a bottom rail fastening point 73, since the cross strut 67 is fastened to the support 66A, 66B between these rail fastening points 72, 73. Detailed explanations with respect to the rail fastening points 72, 73 can be found further below in the description with respect to FIG. 4.

In order that the plate belt 58 can freely move in the running direction, the supports 66A, 66B have to be arranged on the side of the guide rails 56A, 56B remote from the plate belt 58. In order to make this possible the guide rails 56A, 56B or the illustrated guide rail sections have, for each cross strut 67, a passage 75, which is covered by the support and through which the associated cross strut 67 extends and is fastened to the support 66A, 66B. The guide rail 56A, 56B is formed to be C-shaped in cross-section with respect to its length direction and includes not only a top guide track 76 for the plate belt section of the forward run 59, but also a bottom guide track 77 for the plate section of the return run 60. Lateral guide strips 78 are arranged at the edge of the guide tracks 76, 77 for lateral guidance of the plate belt 58.

A handrail-guide fastening region 80, to which guide parts such as the illustrated handrail guide rollers 81 can be fastened, is formed at the support 66A, 66B above the rail fastening region 71. Handrail guide rails can obviously also be mounted on these handrail-guide fastening regions 80. In addition, the support 66A, 66B has a base fastening region 82, to which a base plate (not illustrated) can be fastened directly or, as illustrated, by means of a base plate girder 83.

Formed at the top end of the support 66A, 66B is a balustrade fastening region 85 at which a clamping device 86 is arranged, in which clamping device 86, as illustrated in FIG. 4, a glass balustrade 57A, 57B can be fastened. In addition, the support 66A, 66B can have further fastening regions to which mounts for covers such as, for example, side panels or cover parts of the base can be fastened.

The moving walkway 50 of FIG. 2 is illustrated in FIG. 4 in the cross-section A-A. The support structure 55, the guide rails 56A, 56B and the plate belt 58 correspond with the components illustrated in FIG. 3 and already described, for which reason these have the same reference numerals. It can be readily seen in FIG. 4 that the at least one cross strut 67 passes through the two guide rails 56A, 56B and that the rail fastening region 71 is subdivided into a top rail fastening point 72 and a lower rail fastening point 73. The two rail fastening points 72, 73 have lugs 87 or hooks and the guide rails 56A, 56B have slots (visible in FIG. 3 at the guide rail 56B), so that the guide rails 56A, 56B can be suspended by the slots in the lugs 87. These joining aids substantially simplify assembly and contribute to precise positioning of the guide rail 56A, 56B relative to the supports 66A, 66B and the cross strut 67. The guide rails 56A, 56B are secured to the support 66A, 66B by means of screws, but other known fastening means such as bolting, riveting, weld connections, clinch connections, clamping, snap and key connections and the like are also usable.

In order to increase the stability of shape of the guide tracks 76, 77 the guide rails 56A, 56B have, at both guide tracks 76, 77, downwardly directed bent portions 91, 92. The bent portion 91 of the top guide track 76 is additionally supported by its end on the cross strut 67, since the guide track 76 of the plate belt forward run 59 has to support substantially higher conveying or weight loads, which are caused by the users of the moving walkway 50, than the guide track 77 of the plate belt return run 60.

The base fastening region 82, which is described in connection with FIG. 3 and to which the base plate girder 83 is fastened, can also be readily seen. This carries a base plate 95 and is supported at the support structure 55 or support 66A, 66B. The balustrade fastening regions 85 with the clamping devices 86, which are arranged thereat, for mounting of the two balustrades 57A, 57B are also illustrated. In addition, further parts of the base, such as cover plates 96, 97 and side cladding parts 98, are supported relative to the carrying structure 51 by the supports 66A, 66B of the support structure 55 via the foot fastening regions 68 of the supports 66A, 66B.

Although the invention has been described in detail on the basis of a track module of a moving walkway it will be obvious that a track module of an escalator can also be constructed in the same manner. In addition, numerous further variants can be created with knowledge of the present invention, for example through the modernisation of existing escalators or moving walkways, by the escalator according to the invention or the moving walkway according to the invention by virtue of the possibility of combination with carrying structures of any design.

The invention claimed is:

1. A track module of an escalator or moving walkway for forming a system of interconnected modules extending the track of the escalator or moving walkway between deflecting regions, the module comprising two support structures and parallel unitary one-piece guide rails supported by and connecting the support structures, each support structure consisting essentially of two vertical supports and a cross strut extending orthogonal to the guide rails joining the vertical supports, each vertical support having a foot fastening region for fastening to a carrying structure and a balustrade fastening region for supporting a balustrade and transmitting forces from the balustrade directly through the vertical support to the carrying structure, each unitary guide rail comprising an integral upper guide track for a forward run of a step/plate belt and an integral lower guide track for a return run of the step/plate belt and transverse passages between the upper and lower guide tracks, the support structure cross strut extending through the transverse passages for connection to the vertical supports, each guide rail being fastened directly to a rail fastening region of the vertical supports at a guide rail location between the upper and lower guide tracks, the module further being adapted for interconnection with at least one other module at adjacent ends thereof by fasteners between aligned adjacent ends of the guide rails of the modules to form a unitary extended guide rail assembly between the deflecting regions, the track module providing for increased ease and efficiency in assembling a escalators or moving walkway at the intended installation location by providing simplified interconnection between one or more of such modules and the deflecting regions.

2. The track module of claim 1, wherein the guide rails are C-shaped in cross-section, the guide tracks being formed by upper and lower legs of the C-shape.

3. The track module of claim 2, wherein lugs for suspension of a guide rail are formed at the vertical supports in the rail fastening region.

4. The track module according to claim 1, wherein the rail fastening region of the vertical supports is located at the cross struts.

5. The track module of claim 1, wherein the vertical supports have at least one base fastening region for the fastening of a base plate.

6. The track module of claim 1, wherein the vertical supports have at least one handrail-guide fastening region for the fastening of a handrail guide.

7. The track module of claim 1, wherein the foot fastening region comprises a height adjusting device.

8. An escalator having a step belt and balustrades arranged laterally of the step belt in a length direction of the escalator and with first and second deflecting regions with the step belt arranged between the first and second deflecting regions to circulate, wherein the escalator further comprises at least one track module according to claim 2 arranged between the deflecting regions, wherein the deflecting regions are connected together by the at least one of the track modules and the at least one guide rail of the at least one track module guides the step belt between the deflecting regions.

9. A moving walkway having a plate belt and balustrades arranged laterally of the plate belt in a length direction of the moving walkway and with first and second deflecting regions with the plate belt arranged between the deflecting regions to circulate, the moving walkway further comprising at least one track module according to claim 2 arranged between the deflecting regions, wherein the deflecting regions are connected together by the at least one track module and the at least one guide rail of the at least one track module guides the plate belt between the deflecting regions.

10. The escalator of claim 8 wherein the first deflecting region, the second deflecting region and at least one foot fastening region of at least one track module arranged between the two deflecting regions are fastened to associated mounts arranged in distribution over a length of a carrying structure erected at a building.

11. A method of assembling an escalator of claim 8, comprising the steps of:

fastening the first and second deflecting regions to a carrying structure;

fastening the at least one track module through the foot fastening regions thereof to the carrying structure between the two deflecting regions;

connecting the two deflecting regions together by the at least one guide rail of the at least one track module; and introducing the step belt between the deflecting regions for movement in circulation and guidance by the at least one guide rail and fastening the balustrades to the vertical supports of at least one of the support structures.

12. A method of modernizing an escalator in which an existing escalator is removed to leave an emptied framework to serve as a carrying structure, comprising the steps of:

providing the emptied framework in a region of a bottom chord thereof with mounts to which foot fastening regions of supports of track modules can be fastened; and fastening first and second deflecting regions and at least one track module of claim 1 to the emptied framework such that the foot fastening regions of the supports connect with the mounts.

13. A moving walkway of claim 9, wherein the first and second deflecting regions and at least one foot fastening region of at least one track module arranged between the two deflecting regions are fastened to associated mounts arranged in distribution over a length of a carrying structure erected at a building.

14. A method of assembling a moving walkway of claim 13, comprising the steps of:

fastening the first and second deflecting regions to a carrying structure;

fastening the at least one track module through the foot fastening regions thereof to the carrying structure between the two deflecting regions;

connecting the two deflecting regions together by the at least one guide rail of the at least one track module;

introducing the plate belt between the deflecting regions for movement in circulation and guidance by the at least one guide rail; and fastening the balustrades to the vertical supports of at least one of the support structures.

15. A method of modernizing a moving walkway wherein an existing moving walkway is removed to leave an emptied framework to serve as a carrying structure, comprising the steps of:

providing the emptied framework in a region of a bottom chord thereof with mounts to which foot fastening regions of supports of a track module can be fastened, and fastening first and second deflecting regions and at least one track module of claim 1 to the emptied framework such that the foot fastening regions of the supports connect with the mounts.

* * * * *